US005915540A

United States Patent [19]

Chou

[11] Patent Number: 5,915,540

[45] Date of Patent: Jun. 29, 1999

[54] STRAP CONNECTING DEVICES FOR SWIMMING GOGGLES

[76] Inventor: Terry Chou, No. 12, Hsin Ho Herng Road, Tainan City, Taiwan

[21] Appl. No.: 09/042,636

[22] Filed: Mar. 17, 1998

[51] Int. Cl.[6] ..... A61F 9/02; A44B 11/02

[52] U.S. Cl. ..... 2/428; 2/452; 24/168; 24/197; 24/198

[58] Field of Search ..... 2/426, 431, 434, 2/438, 439, 440, 441, 442, 443, 445, 446, 452; 24/170, 197, 168, 200

[56] References Cited

U.S. PATENT DOCUMENTS 4,417,372 11/1983 Ronci ..... 24/197
4,564,960 1/1986 Nishiyama ..... 2/452
4,932,104 6/1990 Kowal ..... 24/170
5,566,427 10/1996 Lathrop ..... 24/169

*Primary Examiner*—John J. Calvert
*Assistant Examiner*—Katherine Moran
*Attorney, Agent, or Firm*—Rosenberg, Klein & Bilker

[57] ABSTRACT

A connecting device for a pair of swimming goggles includes a first end securely attached to a frame of the swimming goggles and a second end including a first part and a second part releasably engaged with the first part. The strap is movable between the first part and the second part to adjust a length of a strap when the first part and the second part are disengaged from each other. The strap is retained in position between the first part and the second part when the first part and the second part are engaged with each other.

7 Claims, 8 Drawing Sheets

STRAP CONNECTING DEVICES FOR SWIMMING GOGGLES

BACKGROUND OF THE INVENTION

The present invention relates to strap connecting devices for swimming goggles.

FIGS. 7 to 9 of the drawings illustrate a typical conventional strap connection for swimming goggles, in which the strap connecting member 1' is made of rigid material and comprises a first end 11' connected to a frame 3' (FIGS. 8 and 9) of a pair of swimming goggles and a second end 12'. The second end 12' is substantially hollow and includes two spaced transverse beams 121' and 122' and an access 123' defined in an end edge thereof, thereby defining three spaces 124', 125', and 126'. In assembly, as shown in FIG. 8, an end of the strap 2' is first wound through the spaces 126', 125', and 125' in sequence and then extended into the space 126' and finally fixed in position (FIG. 9). Nevertheless, the assembly procedure and re-adjustment of the length of the strap are troublesome. In addition, connection between the strap 2' and the strap connecting member 1' is not smooth which may cause an uncomfortable feeling. The present invention is intended to provide improved strap connecting devices for swimming goggles which mitigate and/or obviate the above problems.

SUMMARY OF THE INVENTION

In accordance with one aspect of the invention, a connecting device is provided for a pair of swimming goggles having a frame and a strap. The connecting device comprises a first end securely attached to the frame and a second end including a first part and a second part releasably engaged with the first part. The strap is movable between the first part and the second part to adjust a length of the strap when the first part and the second part are disengaged from each other. The strap is retained in position between the first part and the second part when the first part and the second part are engaged with each other.

In a preferred embodiment of the invention, a connecting device includes a first member and a second member. The first member has a first end and a second end, wherein the second end of the first member includes a compartment through which a strap of a pair of swimming goggles is extendible and a first open end edge through which the strap is extendible. The second member has a first end releasably engagable with the first end of the first member and a second end releasably engagable with the second end of the second member. The first end of the first member and the first end of the second member are securely attached to a frame of a pair of swimming goggles. The second member further includes a bendable section formed between the first end and second end thereof to allow the first end and the second end thereof to be bendable relative to each other. The second end of the second member includes a bottom wall having an opening defining therein. A beam extends across the opening and around which the strap is windable. The bottom wall further includes a second open end edge through which the strap is extendible.

The strap is movable between the second end of the first member and the second end of the second member to adjust a length of the strap when the second end of the first member and the second end of the second member are disengaged from each other. The strap is retained in position between the second end of the first member and the second end of the second member when the second end of the first member and the second end of the second member are engaged with each other.

One of the first end of the first member and the first end of the second member includes at least one snapping fastener formed thereon, and the other of the first end of the first member and the first end of the second member includes at least one notch for releasably engaging with said at least one snapping fastener.

One of the second end of the first member and the second end of the second member includes at least one snapping fastener formed thereon, and the other of the second end of the first member and the second end of the second member includes at least one notch for releasably engaging with said at least one snapping fastener.

The second end of the first member includes a projection to securely retain the strap in position when the second end of the first member and the second end of the second member are engaged with each other.

The bottom wall of the second end of the second member includes a projection to securely retain the strap in position when the second end of the first member and the second end of the second member are engaged with each other.

The bottom wall of the second end of the second member may include an inclined surface which faces the beam to allow smooth winding and extending of the strap.

Other objects, advantages, and novel features of the invention will become more apparent from the following detailed description when taken in conjunction with the accompanying drawings.

DESCRIPTION OF THE PREFERRED EMBODIMENTS

Figure 1:
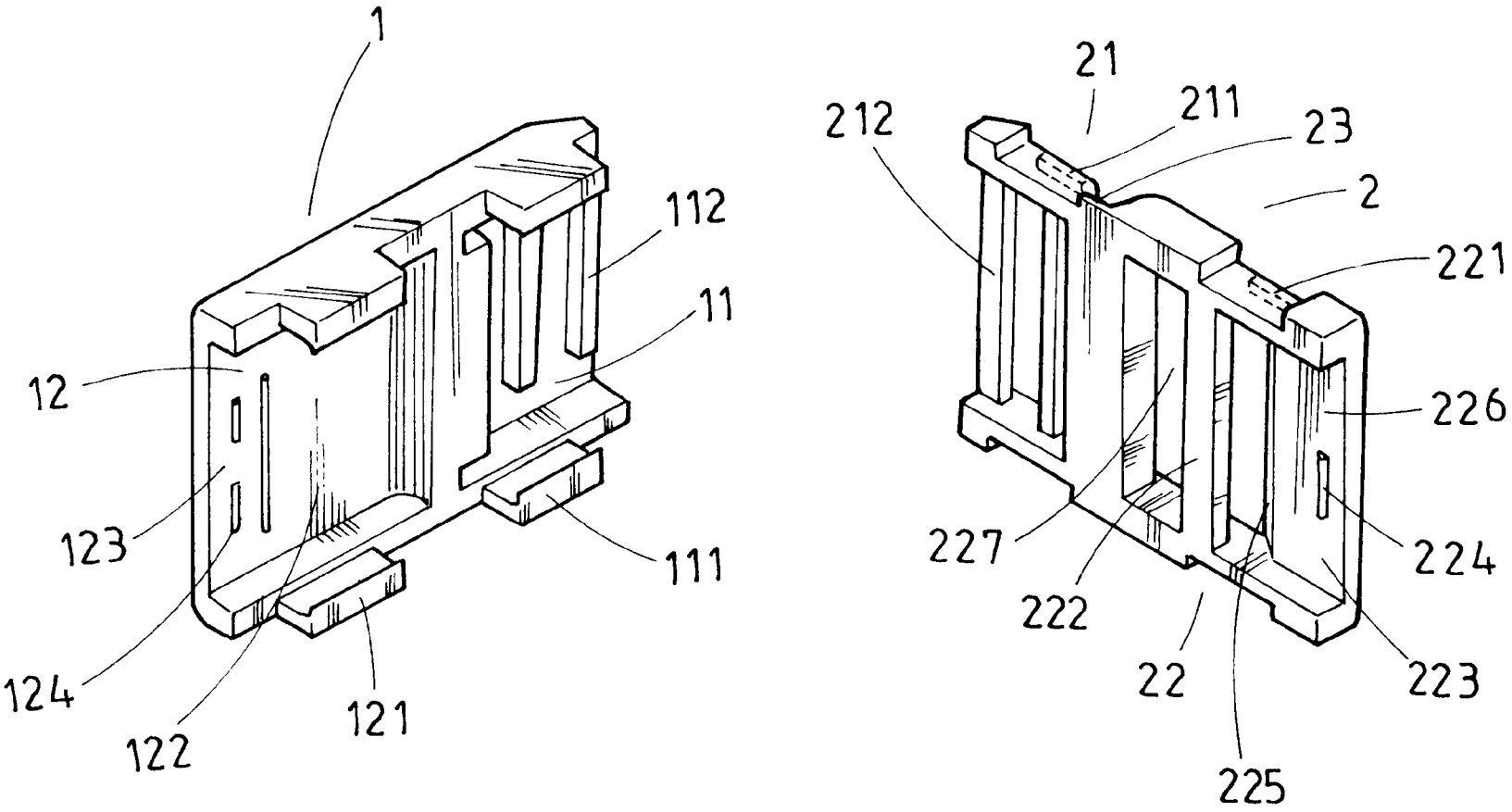
FIG. 1 is an exploded perspective view of a strap connecting device for swimming goggles in accordance with the present invention.
Figure 2:
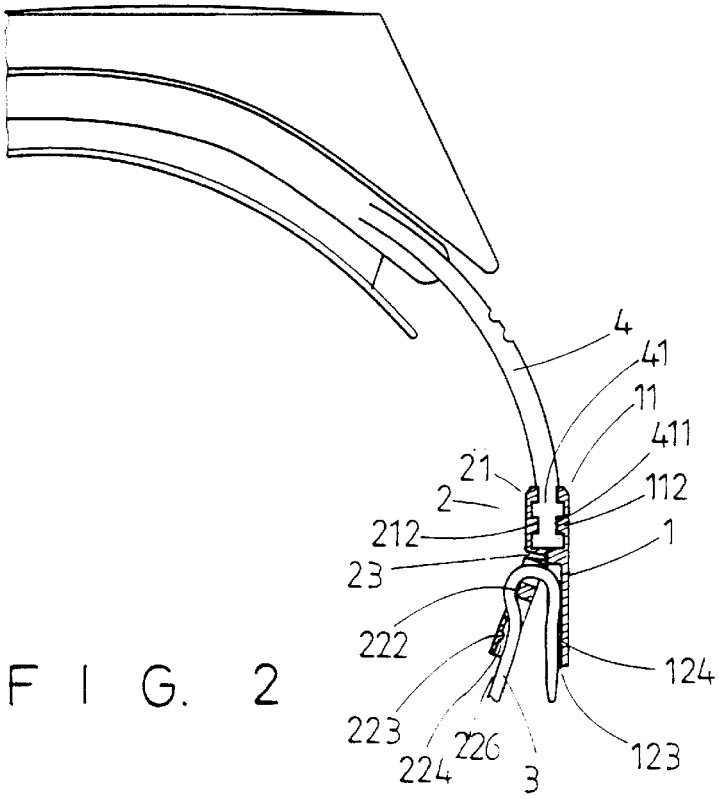
FIG. 2 is a partial top view, partly sectioned, of a pair of swimming goggles using the strap connecting device in accordance with the present invention.
Figure 3:
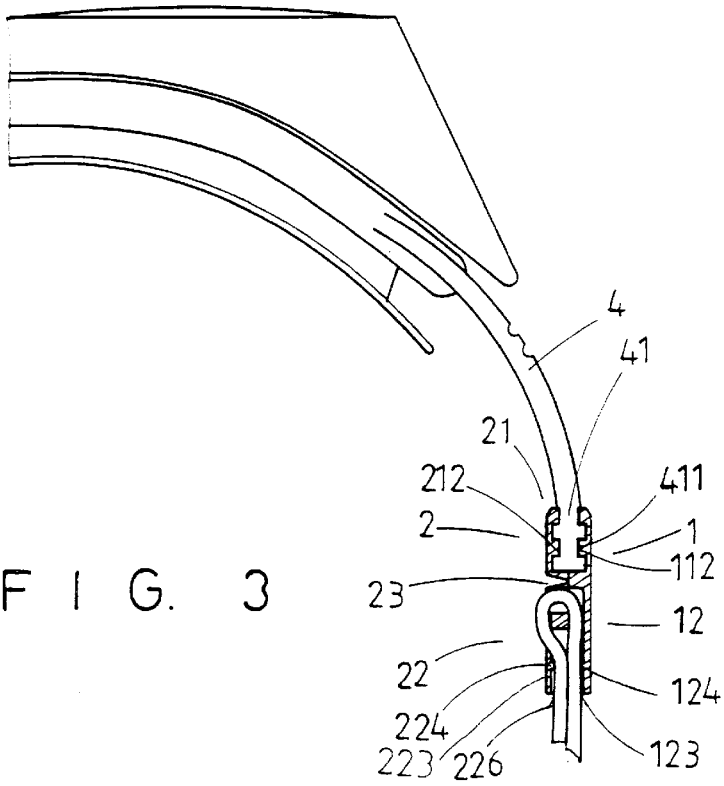
FIG. 3 is a view similar to FIG. 2, wherein the strap connecting device is in a closed status.

Referring to FIGS. 1 to 6 of the drawings and initially to FIG. 1, a strap connecting device for swimming goggles in accordance with the present invention generally includes a first member 1 and a second member 2 which has a portion releasably engaged with the first member 1 to hold a section of a strap 3 (FIGS. 2 and 3). Each of the first member 1 and the second member 2 includes a first end 11, 21 and a second end 12, 22, wherein the first end 11 and second end 12 of the first member 1 respectively include snapping fasteners 111 and 121 for releasably engaging with notches 211 and 221 respectively defined in the first end 21 and second end 22 of the second member 2. It is appreciated that the releasably engagement between the first ends 11, 21 and second ends 12, 22 of the first and second members 1 and 2 can be of any other suitable means.

Figure 4:
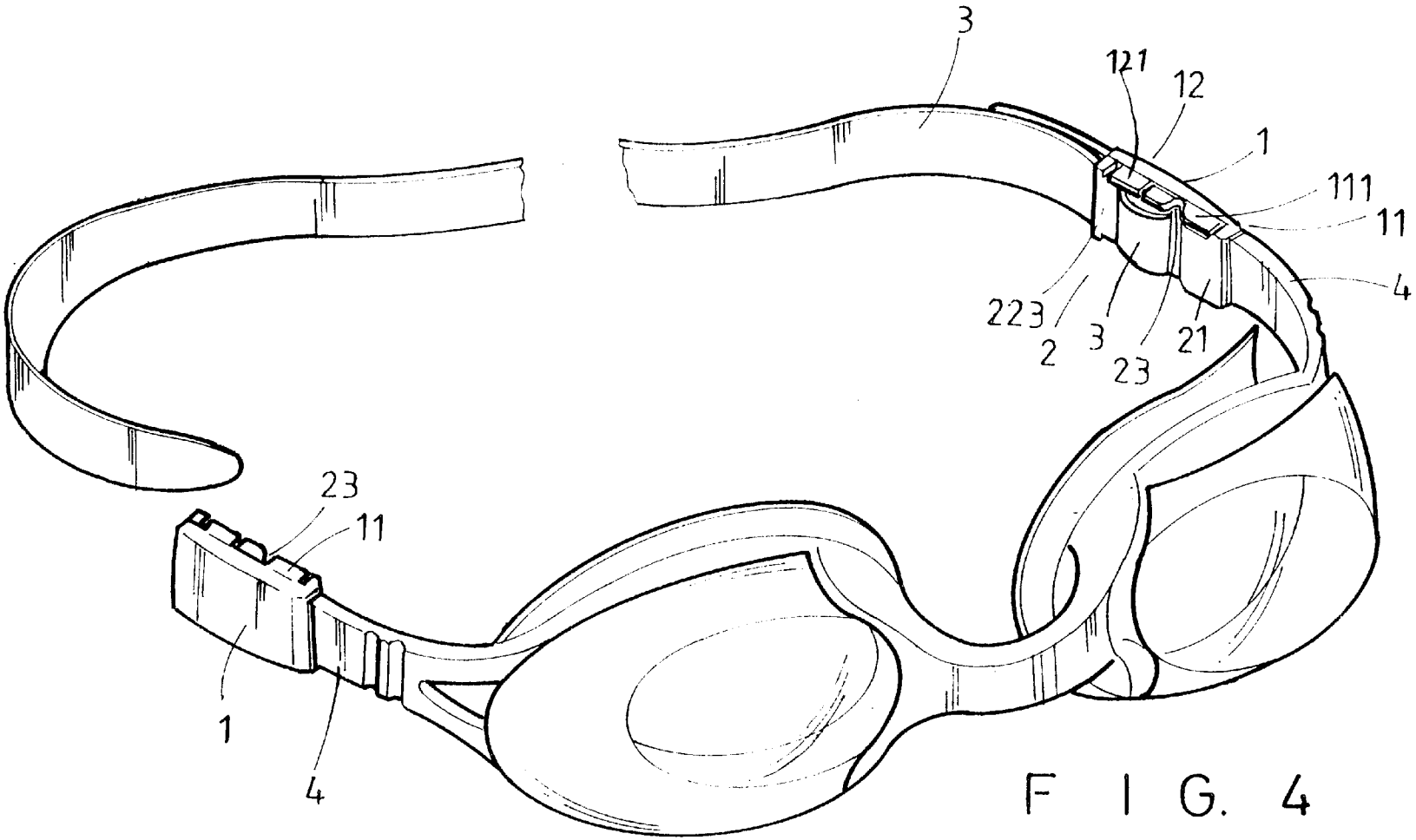
FIG. 4 is a perspective view of the pair of swimming goggles using the strap connecting device in accordance with the present invention.

As shown in FIG. 1, the first end 11 of the first member 1 includes two ribs 112, while the first end 21 of the second member 2 also includes two ribs 212 so as to securely hold an engaging section 411 of a distal end 41 of an extension 4 extending from a side of a frame of a pair of swimming goggles (see FIGS. 2 to 4).

Turning back to FIG. 1, the second end 12 of the first member 1 includes a compartment 122 for receiving a portion of a strap 3 (see FIGS. 2 and 3). The second end 12 of the first member 1 further includes an open end edge 123 through which the strap 3 is extendible. In addition, a projection 124 is formed on a bottom wall (not labeled) defining the compartment 122, which will be described later.

The second end 22 of the second member 2 includes a bottom wall 223 which has an opening 227 (FIG. 2) defined therein, and a beam 222 is extended across the opening 227 to allow the strap 3 to wind through. The bottom wall 223 includes an open end edge 226 through which the strap 3 is extendible. The first end 21 and the second end 22 of the second member 2 may include a bendable section 23 (e.g., by means of forming a V-shaped groove) formed therebetween such that one of the first and second ends 21 and 22 may be bendable relative to the other.

Figure 5:
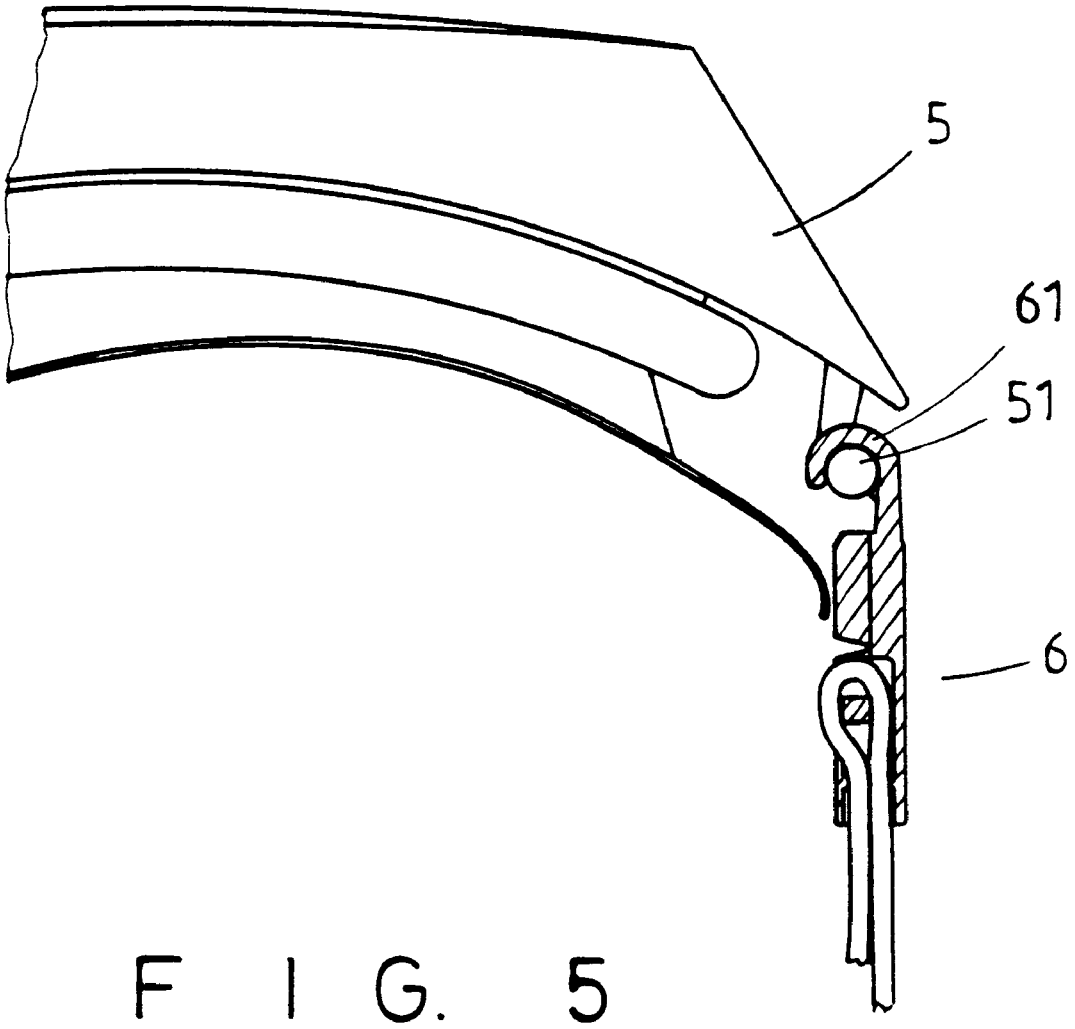
FIG. 5 is a view similar to FIG. 2, illustrating a modified embodiment of the strap connecting device in accordance with the present invention.

In assembly, as shown in FIG. 2, the first end 11 of the first member 1 and the first end 21 of the second member 2 together hold the distal end 41 of the extension 4, and the snapping fasteners 111 of the first end 11 of the first member 1 is engaged with the notches 211 of the first end 21 of the second member 2. It is appreciated that the strap connecting device can be retained in a status shown in FIG. 2 as the second member 2 includes a bendable section 23 defined between the first and second ends 21 and 22 thereof. It is further appreciated that the first end 11 of the first member 1 and the first end 21 of the second member 2 can be attached to the frame of a pair of swimming goggles in any other desired manners, and an example of which is illustrated in FIG. 5, wherein the strap connecting device (now designated by reference numeral "6") includes a hook end 61 attached to an engaging beam or post 51 of a frame 5 of a pair of swimming goggles. Alternatively, the first ends 11 and 21 can be integrally formed. An end of the strap 3 is wound through the beam 222 in a manner shown in FIG. 2. Then, the second end 22 of the second member 2 is moved toward the second end 12 of the first member 2, while the snapping fasteners 121 of the second end 12 of the first member 1 is caused to engage with the notches 221 of the second end 22 of the second member 2, as shown in FIGS. 3 and 4.

The bottom wall 223 of the second end 22 of the second member 2 may include an inclined surface 225 which faces the beam 222 to assist in smooth winding and extending of the strap 3 in the strap connecting member 1. In addition, the bottom wall 223 of the second end 22 of the second member 2 may include a projection 224 formed thereon to cooperate with the first-mentioned projection 124 on the first member 1 to securely retain the end of the strap 3 in position when the strap connecting device is in a closed position shown in FIG. 3.

When, re-adjustment of length of the strap 3 is required, the user may pull the strap 3 inwardly which causes disengagement of the notches 221 of the second member 2 from the snapping fasteners 121 of the first member 1. As a result, the second end 22 of the second member 2 is disengaged from the second end 12 of the first member 1. In other words, the strap connecting device is changed from the status shown in FIG. 3 to the status shown in FIG. 2 such that the user may simply pull the strap 3 to adjust the length of the strap 3.

Figure 6:
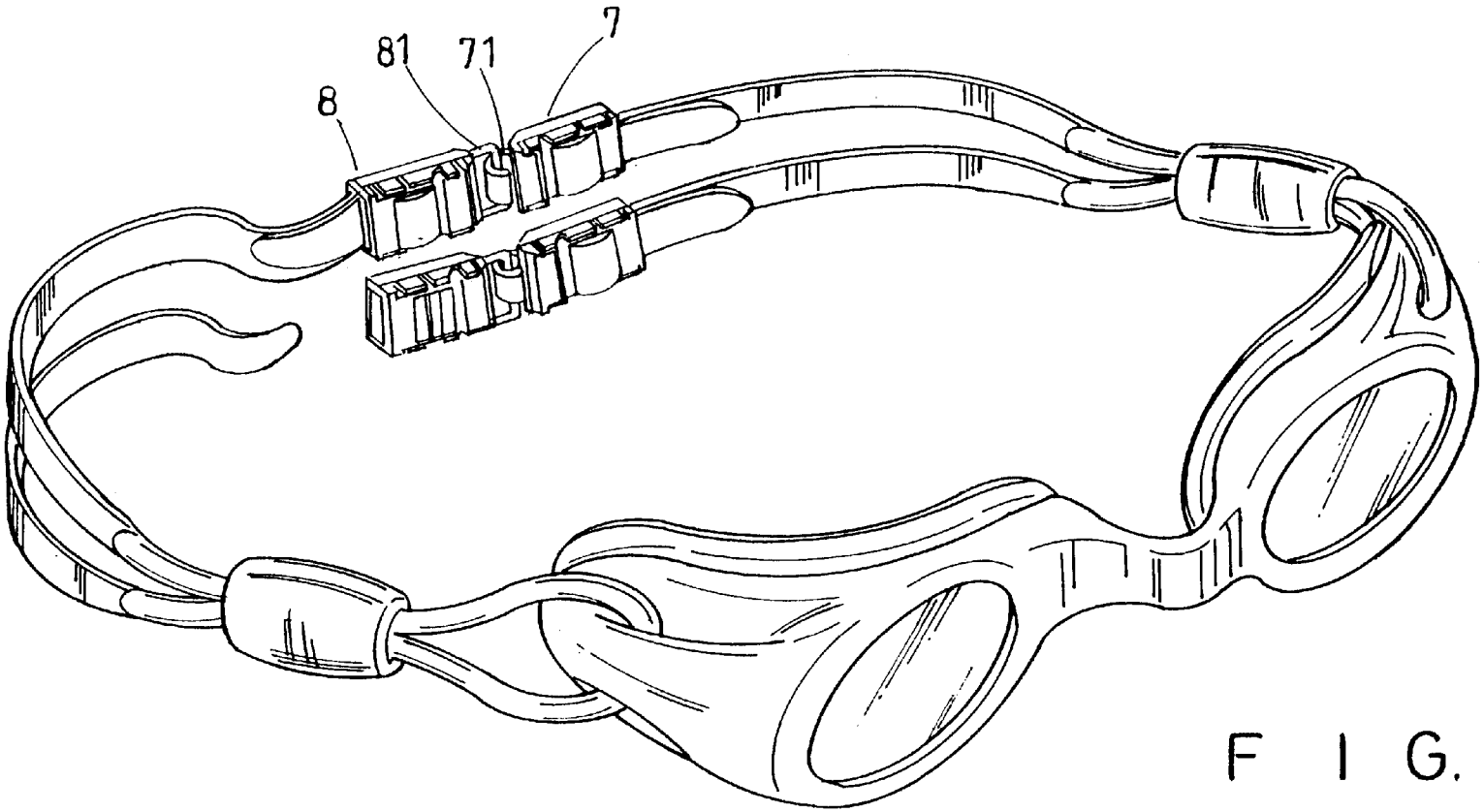
FIG. 6 is a perspective view illustrating a modified arrangement of the present invention on a pair of swimming goggles.
Figure 7:
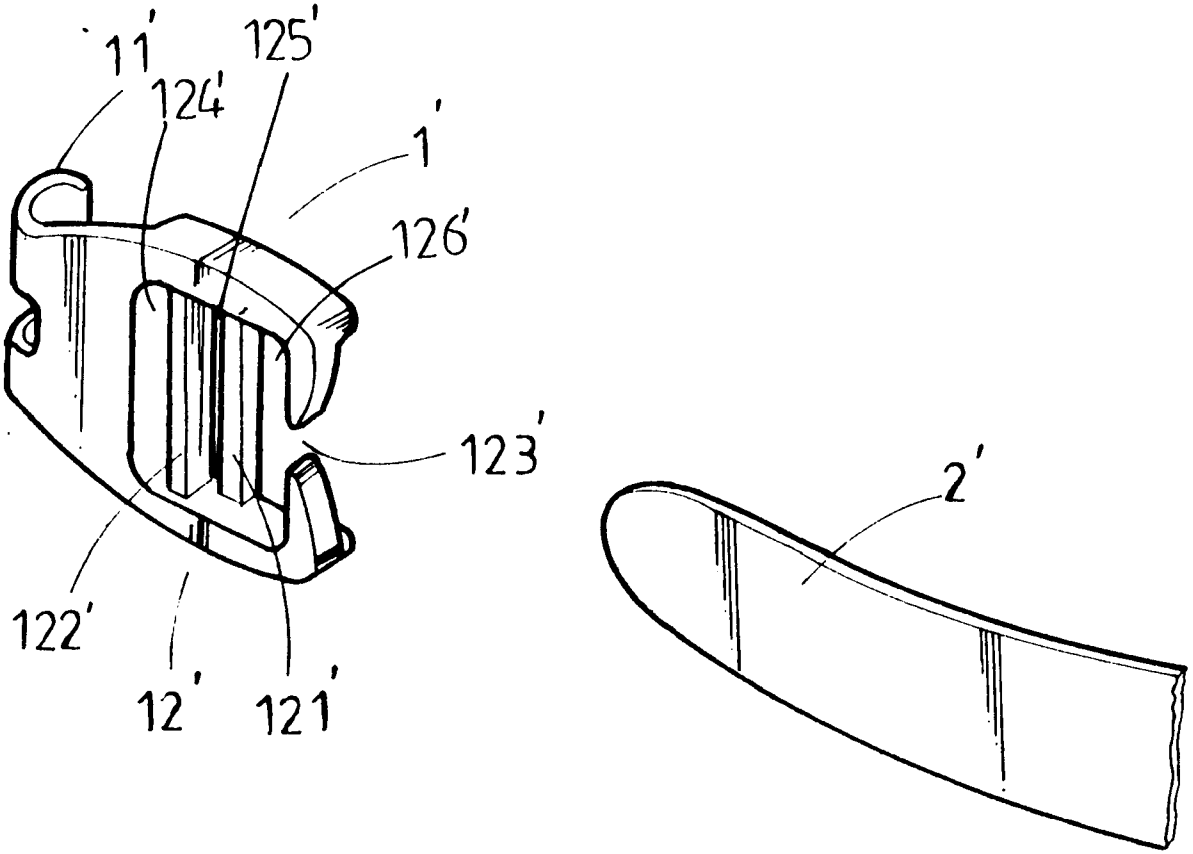
PRIOR ART FIG. 7
FIG. 7 is an exploded perspective view of a portion of a strap and a conventional strap connecting member.
Figure 8:
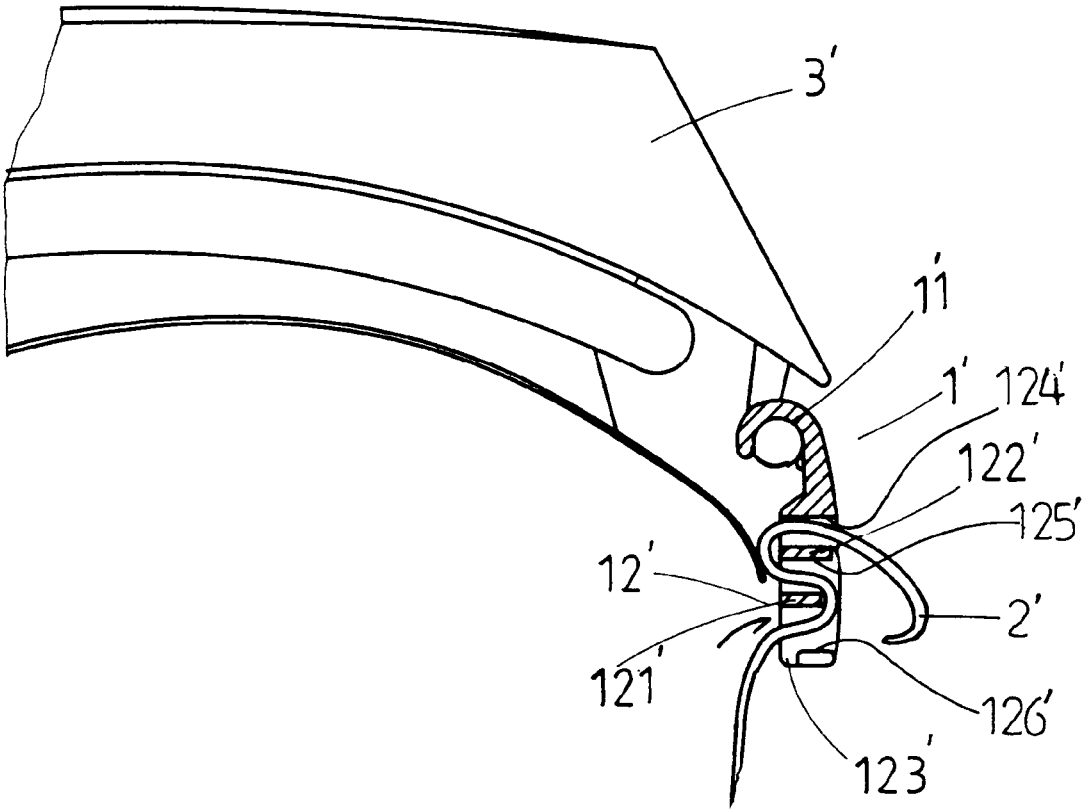
PRIOR ART FIG. 8
FIG. 8 is a partial top view, partly sectioned, of a pair of swimming goggles using the strap connecting member in FIG. 7.
Figure 9:
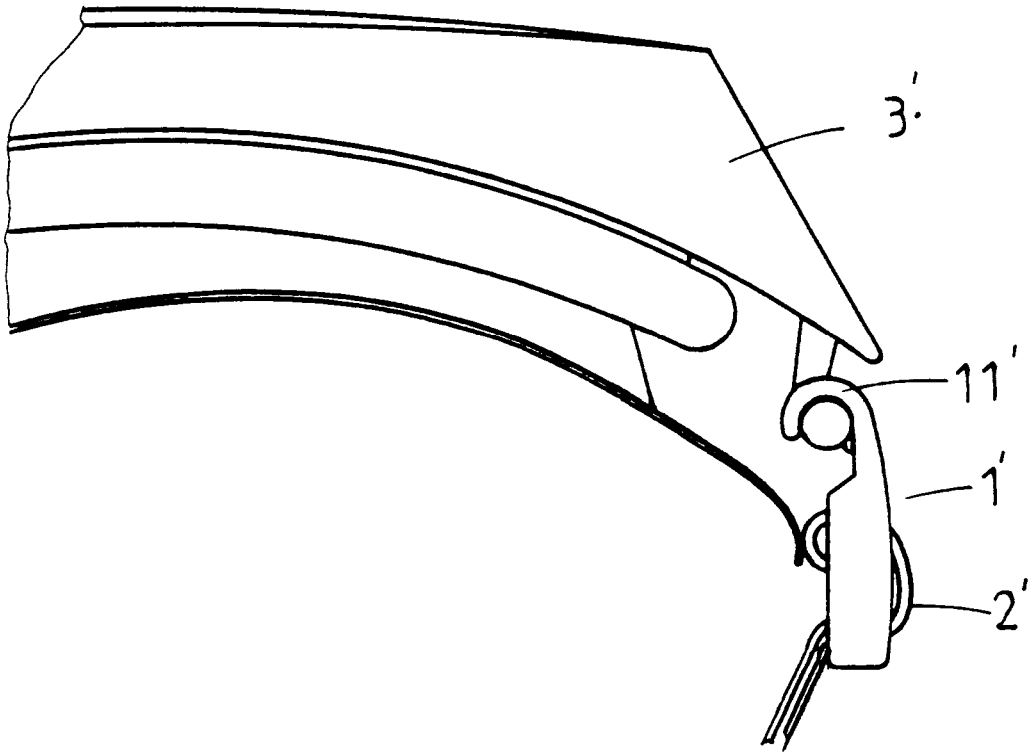
PRIOR ART FIG. 9
FIG. 9 is a top view illustrating the swimming goggles in FIG. 8.

FIG. 6 illustrates a modified embodiment of the present invention, in which two strap connecting devices 7 and 8 are provided for each strap section, and in which each two connected strap connecting devices 7 and 8 include hook 71 and ring 81 engagement for mutual connection.

According to the above description, it is appreciated that the strap connecting device in accordance with the present invention allows easy assembly and length adjustment of the strap. In addition, the strap can be securely retained in position after adjustment. Further, the inclined surface 225 of the second member 2 allows easy assembly and length adjustment of the strap. Further, the resultant pair of swimming goggles does not cause uncomfortable feeling to the user.

Although the invention has been explained in relation to its preferred embodiment, it is to be understood that many other possible modifications and variations can be made without departing from the spirit and scope of the invention as hereinafter claimed.

What is claimed is:

1. A connecting device for a pair of swimming goggles having a frame and a strap, the connecting device comprising:

a first fur securely attaching to the frame, and a second end comprising a first part and a second part releasably engaged with the first part, wherein the strap is movable between the first part and the second part to adjust a length of the strap when the first part and the second part are disengaged from each other, and wherein the strap is retained in position between the first part, and the second part when the first part and the second part are engaged with each other, said second part of said second end having a bendable section for reversibly displacing the second end first and second parts.

2. A connecting device for a pair of swimming goggles having a frame and a strap, the connecting device comprising:

a first member having a first end and a second end, the second end of the first member including a compartment through which the strap is extendible and a first open end edge through which the strap is extendible, and a second member having a first end releasably engagable with the first end of the first member and a second end releasably engagable with the second end of the second member, the first end of the first member and the first end of the second member being securely attached to the frame, the second member further including a bendable section formed between the first end and second end thereof to allow the first end and the second end thereof to be bendable relative to each other, the second end of the second member including a bottom wall having an opening defining therein, a beam extending across the opening and around which the strap is windable, the bottom wall further including a second open end edge through which the strap is extendible, wherein the strap is movable between the second end of the first member and the second end of the second member to adjust a length of the strap when the second end of the first member and the second end of the second member are disengaged from each other, and wherein the strap is retained in position between the second end of the first member and the second end of the second member when the second end of the first member and the second end of the second member are engaged with each other.

3. The connecting device according to claim 2, wherein one of the first end of the first member and the first end of the second member includes at least one snapping fastener formed thereon, and the other of the first end of the first member and the first end of the second member includes at least one notch for releasably engaging with said at least one snapping fastener.

4. The connecting device according to claim 2, wherein one of the second end of the first member and the second end of the second member includes at least one snapping fastener formed thereon, and the other of the second end of the first member and the second end of the second member includes at least one notch for releasably engaging with said at least one snapping fastener.

5. The connecting device according to claim 2, wherein the second end of the first member includes a projection to securely retain the strap in position when the second end of the first member and the second end of the second member are engaged with each other.

6. The connecting device according to claim 2, wherein the bottom wall of the second end of the second member includes a projection to securely retain the strap in position when the second end of the first member and the second end of the second member are engaged with each other.

7. The connecting device according to claim 2, wherein the bottom wall of the second end of the second member includes an inclined surface which faces the beam.

* * * * *